US005272925A

United States Patent [19]

Henneuse et al.

[11] Patent Number: 5,272,925

[45] Date of Patent: Dec. 28, 1993

[54] MOTORIZED ROTARY SWIVEL EQUIPPED WITH A DYNAMOMETRIC MEASURING UNIT

[75] Inventors: Henry Henneuse; Denis Becq, both of Pau, France

[73] Assignee: Societe Natinoale Elf Aquitaine (Production), France

[21] Appl. No.: 861,781

[22] PCT Filed: Oct. 17, 1991

[86] PCT No.: PCT/FR91/00812

§ 371 Date: Aug. 7, 1992

§ 102(e) Date: Aug. 7, 1992

[87] PCT Pub. No.: WO92/07162

PCT Pub. Date: Apr. 30, 1992

[30] Foreign Application Priority Data

Oct. 19, 1990 [FR] France ..... 90 12978

[51] Int. Cl.[5] ..... G01L 1/00

[52] U.S. Cl. ..... 73/862.541; 73/862.191; 73/151

[58] Field of Search ..... 73/862.541, 862.191, 73/151; 175/40

[56] References Cited

U.S. PATENT DOCUMENTS

| | | | |
|---|---|---|---|
| 3,855,853 | 12/1974 | Claycomb | 73/151 |
| 3,855,857 | 12/1974 | Claycomb | 73/151 |
| 3,876,972 | 4/1975 | Garrett | 340/18 |
| 4,285,238 | 8/1982 | Chien | 73/151 |
| 4,449,596 | 5/1984 | Boyadjieff | 175/85 |
| 4,715,451 | 12/1987 | Bseisu et al. | 175/40 |
| 4,811,597 | 3/1989 | Hebel | 73/151 |
| 4,852,665 | 8/1989 | Peltier et al. | 73/151 |
| 4,958,125 | 9/1990 | Jardine et al. | 73/151 |
| 5,182,946 | 2/1993 | Boughner et al. | 73/151 |

FOREIGN PATENT DOCUMENTS 2642791 8/1990 France .

*Primary Examiner*—Richard E. Chilcot, Jr.
*Assistant Examiner*—Elizabeth L. Dougherty
*Attorney, Agent, or Firm*—Bacon & Thomas

[57] ABSTRACT

A motorised rotary swivel for driving drill pipe in rotation is disclosed. The swivel includes a measuring unit for measuring a dynamometric behavior of the drill pipe which is mounted adjacent to the output of the motor between the motor and a torque wench assembly.

5 Claims, 2 Drawing Sheets

MOTORIZED ROTARY SWIVEL EQUIPPED WITH A DYNAMOMETRIC MEASURING UNIT

BACKGROUND OF THE INVENTION

1. Field of the Invention

The present invention relates to a rotary swivel equipped with a dynamometric measuring unit and, more especially to such a rotary swivel intended to drive a drill pipe in rotation.

2. Description of the Prior Art

There are two types of devices which can be used on a drilling mast for driving a string of pipe in rotation. The first, and the more traditional, is the rotary turn-table which is mounted on the floor of the drilling mast and comprises a square or hexagonal opening intended to receive a drive rod of complementary cross-section. The turn-table is set in rotation and thus causes the rotation of the string of pipe The other type of device is the motorised rotary swivel, where an electric or hydraulic motor, mounted adjacent to the movable pulley block, is linked directly to the upper end of the string of pipe. The motor is mounted on a carriage which slides on rails arranged vertically on the mast thus permitting the movement of the carriage whilst absorbing the torque generated during drilling.

On the other hand, there are dynamometric measuring units which are intended to be mounted on the string of pipe in order to be able to measure the forces and sense the various vibrations of the said string of pipe which are generated during drilling and which can be characteristic either of the behaviour of the string of pipe, or of the state of wear of the tool, or even of the type of rock being destroyed.

Patent Application FR 89 08649 which was filed on 28 Jun. 1989 in the name of the applicant describes such a dynamometric measuring unit for drill pipe in which a series of sensors is mounted on a drill-rod element of reduced length, more ordinarily called "sub". This device is mounted on the upper end of the string of pipe below the automatic wrench which is arranged at the output of the motor.

Despite these advantages, the positioning of the dynamometric measuring unit below the dynamometric wrench is a source of difficulties because, during certain manoeuvres, for example the withdrawal of only some elements of the string of pipe whilst maintaining the circulation of mud, it is necessary to withdraw the measuring unit beforehand. Extra time, resulting from this withdrawal and reassembly of the measuring unit, is thus added to the manoeuvre.

SUMMARY OF THE INVENTION

The object of the present invention is to offset these drawbacks by proposing a motorised rotary swivel equipped with a dynamometric measuring unit which is of simple construction, reliable and which allows all types of manoeuvre to be carried out without disassembly of the measuring unit.

In order to do this, the invention proposes a motorised rotary swivel, intended to drive a drill pipe in rotation, comprising a motor equipped with a principal shaft, characterised in that the rotary swivel comprises, moreover, a measuring unit, comprising at least one sensor, mounted on an extension of the principal shaft adjacent to the output of the motor.

Other features and advantages of the present invention will appear more clearly on reading the description hereinbelow, which is made, by way of example, with reference to the appended drawings in which:

BRIEF DESCRIPTION OF THE FIGURES OF DRAWING

FIG. 1 is a view in perspective of a motorised rotary swivel equipped with a dynamometric measuring unit according to the present invention, FIG. 2 is a view in perspective of a measuring unit intended to be mounted in the rotary swivel of FIG. 1.

DETAILED DESCRIPTION OF THE PREFERRED EMBODIMENTS

Figure 1:
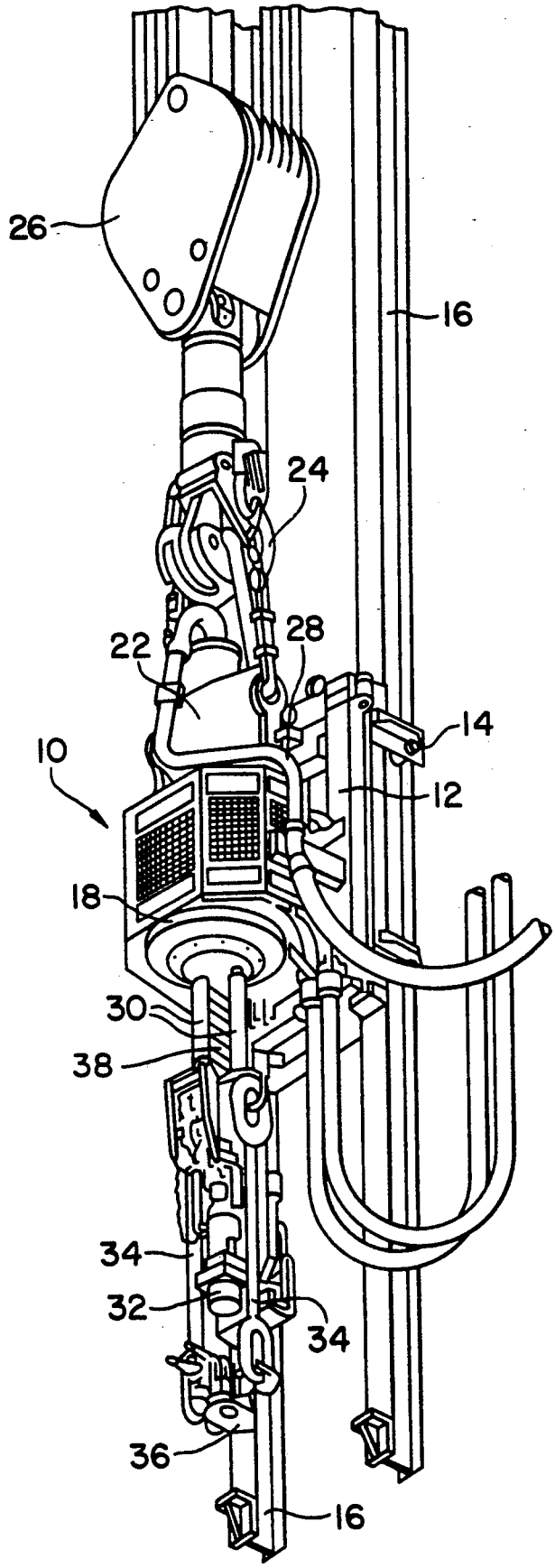

In FIG. 1 is shown a motorised rotary swivel 10 securely mounted on a carriage 12 equipped with rollers 14 which permit the said carriage to slide on two rails 16 which are arranged vertically and are solidly connected to the drilling mast (not shown). The rotary swivel 10 comprises a motor 18 which can be electric or hydraulic and which comprises a hollow principal shaft 20 which is linked by a bearing to a rotary swivel 22 which is also securely mounted on the carriage 12. In a traditional manner, the rotary swivel is suspended from the hook 24 of the movable pulley block 26 which forms part of the winch of the mast (not shown).

The rotary swivel 22 is supplied with mud, in a known fashion, by a flexible tube 28 linked to a source of mud under pressure (not shown). Below the motor 18, and linked to the latter by torque transmission arms 30, can be found the automatic wrench assembly 32 and 34 of the elevator 36.

According to the invention, the dynamometric measuring unit 38 is arranged between the motor 18 and the automatic wrench assembly 32 and the elevator 36.

Figure 2:
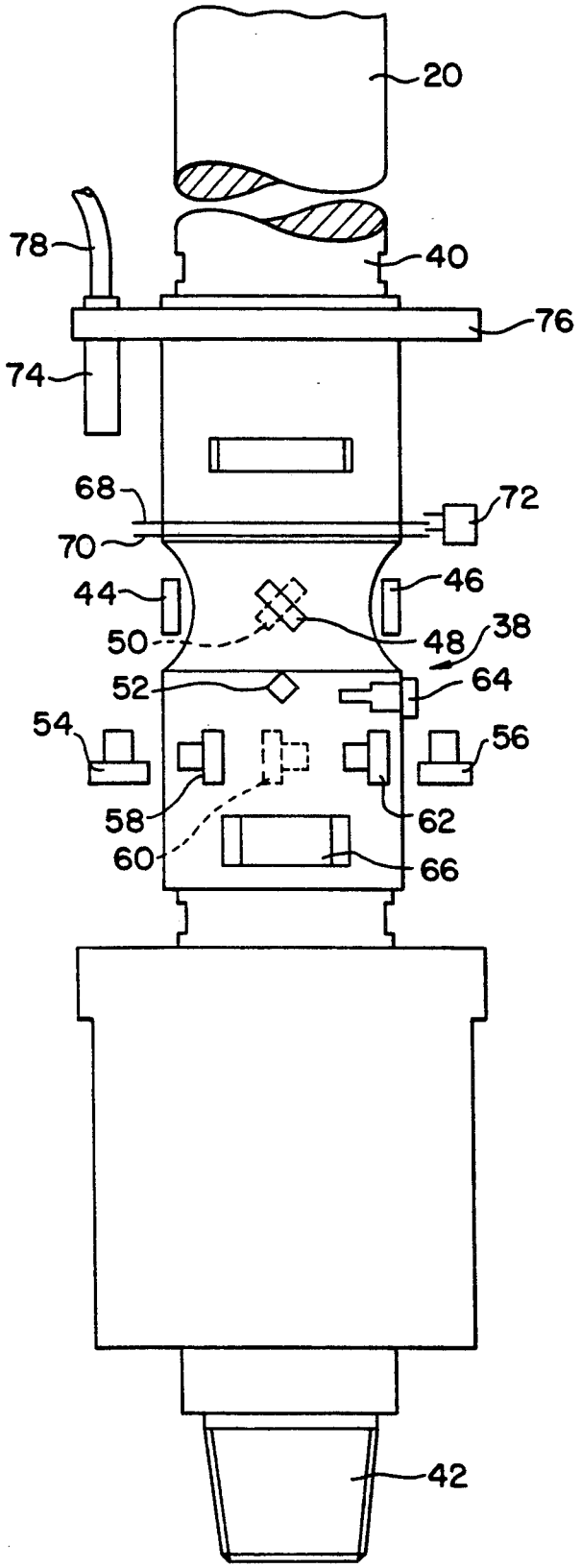

As shown in FIG. 2, the dynamometric measuring unit, represented by 38, comprises a hollow shaft 40 which can be either an extension of the principal shaft 20 or, in a preferred embodiment, a subassembly intended to be mounted on the principal shaft 20 by a threaded part (not shown) and arranged adjacent to the output of the motor 18. The hollow shaft 40 comprises, at its lower end, a threaded male part 42 intended to interact with a corresponding female threaded part at the upper end of the string of pipe (not shown).

The dynamometric measuring unit 38 comprises a series of sensors solidly mounted on its outer surface and forming a measuring unit. In the example illustrated, the unit comprises two traction gauges 44 and 46, a pair of torsion gauges 48, 50, a temperature gauge 52, a pair of longitudinal accelerometers 54, 56 and three transverse accelerometers 58, 60, 62. Moreover, the unit is equipped with a pressure sensor 64. The data generated by the sensors are processed by an electronic conditioning circuit 66 which permits a digital multiplexing of the signals. The electronic circuit is linked to a pair of annular tracks 68, 70 arranged around the shaft 40. A brush-holder assembly 72, mounted so as to rotate with respect to the shaft 40, is intended to pick up the signals from the annular tracks 68, 70. This assembly 72 is linked to a connector 74 arranged on a flange 76 which is also mounted so as to rotate freely on the shaft 40, these elements together forming a rotating collector assembly. The signals are sent to a processing centre remote from the drilling mast via an ordinary transmission cable 78. In an alternative embodiment, the signals can be sent by radio or by magnetic induction. A sheath 80 is intended to be mounted over the flange 76 to protect the various sensors.

Thus, by virtue of the present invention, a centralised measuring unit is arranged in an integral manner in the motorised rotary swivel in such a way as not to necessitate any extra manoeuvre by the driller.

We claim:

1. Motorised rotary swivel for driving drill pipe in rotation, comprising a motor equipped with a principal shaft, a torque wrench assembly, an elevator and a measuring unit for measuring a dynamometric behavior of the drill pipe, said measuring unit comprising at least one sensor, mounted on the principal shaft or an extension of the principal shaft wherein the measuring unit is mounted adjacent to the output of the motor between the motor and the torque wrench assembly.

2. Motorised rotary swivel according to claim 1 wherein the measuring unit is arranged on a subassembly designed to be mounted on the principal shaft at the output of the motor.

3. Motorised rotary swivel according to claim 1 wherein the measuring unit is linked to a processing centre by a cable, the cable being linked to sensors by a rotating collector assembly.

4. Motorised rotary swivel according to claim 1 wherein the measuring unit is linked to a processing centre by radio or by magnetic induction.

5. Motorised rotary swivel according to claim 1 wherein the measuring unit comprises a torsion gauge, a traction gauge and accelerometers.

* * * * *